US009918568B1

(12) United States Patent
Blake

(10) Patent No.: US 9,918,568 B1
(45) Date of Patent: Mar. 20, 2018

(54) POSITION ADJUSTABLE SUPPORT ASSEMBLY

(71) Applicant: James Francis Blake, Prescott Valley, AZ (US)

(72) Inventor: James Francis Blake, Prescott Valley, AZ (US)

( * ) Notice: Subject to any disclaimer, the term of this patent is extended or adjusted under 35 U.S.C. 154(b) by 0 days.

(21) Appl. No.: 15/599,657

(22) Filed: May 19, 2017

(51) Int. Cl.
*A47F 5/08* (2006.01)
*A47B 57/54* (2006.01)
(Continued)

(52) U.S. Cl.
CPC ..... *A47F 5/0807* (2013.01); *A47B 47/0091* (2013.01); *A47B 57/045* (2013.01); *A47B 57/42* (2013.01); *A47B 57/425* (2013.01); *A47B 57/46* (2013.01); *A47B 57/52* (2013.01); *A47B 57/545* (2013.01); *A47B 57/56* (2013.01); *A47B 57/562* (2013.01); *A47B 57/567* (2013.01); *A47B 96/061* (2013.01); *A47B 96/067* (2013.01); *A47F 5/0081* (2013.01); *A47F 5/0087* (2013.01); *A47F 5/0093* (2013.01); *A47F 5/0838* (2013.01); *A47F 5/0846* (2013.01); *A47F 5/10* (2013.01); *A47G 25/0678* (2013.01);
(Continued)

(58) Field of Classification Search
CPC ..... A47F 5/0807; A47F 5/0838; A47F 5/10; A47F 5/0081; A47F 5/0087; A47F 5/0093; A47G 25/0692; A47G 25/0678; A47G 25/0685; A47B 96/067; A47B 57/045; A47B 57/42; A47B 57/425; A47B 57/46; A47B 57/52; A47B 57/56; A47B 57/562; A47B 57/567
USPC ..... 248/294.1, 304, 308, 215; 211/53, 58, 211/94.01, 94.02, 96, 99, 105.1, 170, 171
See application file for complete search history.

(56) References Cited

U.S. PATENT DOCUMENTS 934,569 A * 9/1909 Quinlan ..... A47G 25/0685 211/99
1,706,887 A * 3/1929 Knostman ..... A47B 61/02 211/85.3
(Continued)

FOREIGN PATENT DOCUMENTS

CH 555170 A * 10/1974 ..... A47B 61/003
DE 29510006 U1 * 8/1995 ..... A47F 5/0838
(Continued)

*Primary Examiner* — Eret C McNichols
(74) *Attorney, Agent, or Firm* — Invention To Patent Services; Alex Hobson

(57) ABSTRACT

A position adjustable support assembly provides a support extension that is detachably attachable to a support member. The support extension is attached by an extension attachment that has a support coupler that extends along the length of the support member and has a gap opening to allow the support coupler to be snapped onto the support member. The support coupler may be cylindrical in shape and snap over the rod-shaped support member in a concentric coupling arrangement. The support member has a fin slot for retaining a plurality of fins that extend up from the outside surface of the support member. The fins are slid into a retaining slot along the inside surface of the support coupler to retain the support coupler and support extension in a rotational position with respect to the support member. The support extension can be slid along the length of the support member.

18 Claims, 5 Drawing Sheets

(51) Int. Cl.

| | |
|---|---|
| ***A47B 57/56*** | (2006.01) |
| ***A47B 47/00*** | (2006.01) |
| ***A47B 96/06*** | (2006.01) |
| ***A47F 5/00*** | (2006.01) |
| ***A47G 25/06*** | (2006.01) |
| ***A47F 5/10*** | (2006.01) |
| ***A47B 57/04*** | (2006.01) |
| ***A47B 57/46*** | (2006.01) |
| ***A47B 57/52*** | (2006.01) |
| ***A47B 57/42*** | (2006.01) |
| *A47B 57/30* | (2006.01) |

(52) U.S. Cl.
CPC ..... *A47G 25/0685* (2013.01); *A47G 25/0692* (2013.01); *A47B 57/30* (2013.01); *A47B 57/54* (2013.01); *A47F 5/08* (2013.01)

(56) References Cited

U.S. PATENT DOCUMENTS 2,039,758 A * 5/1936 Wayne ..... A47B 61/02 211/100
2,577,860 A * 12/1951 Schoor ..... A47G 25/0678 211/105.1
2,647,642 A * 8/1953 Kosash ..... A47B 5/04 211/100
3,245,645 A * 4/1966 Dupler ..... A47G 25/0678 248/215
3,976,200 A * 8/1976 Munns ..... B62H 3/12 211/100
4,037,727 A 7/1977 Kunkle
4,146,204 A * 3/1979 Thalenfeld ..... A47F 5/0807 248/220.41
4,316,547 A * 2/1982 Varon ..... A47F 7/24 211/105.1
4,318,486 A 3/1982 Bobrowski
4,997,148 A 3/1991 Sherman
5,236,095 A * 8/1993 Krizka ..... A47B 47/00 211/102
5,332,108 A * 7/1994 Blass ..... A47B 96/067 211/103
5,452,875 A * 9/1995 Kern ..... A47B 57/045 108/108
5,484,519 A 1/1996 Fenton et al.
5,642,557 A 7/1997 Clews
5,695,078 A * 12/1997 Otema ..... A47B 57/045 108/108
5,752,535 A 3/1998 Sanders
5,857,577 A * 1/1999 Thomas ..... A47B 57/26 211/94.01
6,206,210 B1 * 3/2001 Reed ..... A47F 5/0087 211/168
6,561,474 B1 * 5/2003 Walter ..... A47F 5/0815 211/94.01
6,582,096 B1 * 6/2003 Searer ..... A47B 61/003 211/105.1
6,732,984 B2 * 5/2004 Tsai ..... A47F 5/0006 211/17
7,600,729 B2 * 10/2009 Valin ..... A63B 55/61 211/70.2
7,861,871 B2 1/2011 Kao
7,931,161 B2 4/2011 Newbould et al.
8,132,277 B2 3/2012 Buchanan
8,348,301 B2 1/2013 Darling, III
9,380,890 B2 * 7/2016 Mustari ..... A47F 5/02
2007/0170130 A1 7/2007 Plzak
2011/0197542 A1 8/2011 Lawrence O'Toole
2011/0226715 A1 * 9/2011 Schwartzkopf ..... A47B 96/061 211/87.01
2015/0053728 A1 * 2/2015 Womble ..... A47F 5/0838 223/85
2015/0097097 A1 * 4/2015 Early ..... A47G 25/0678 248/215
2015/0189982 A1 * 7/2015 Fitzpatrick ..... A47B 23/043 248/397

FOREIGN PATENT DOCUMENTS

FR 2718000 A3 * 10/1995 ..... A47F 5/0807
FR 2876892 A1 * 4/2006 ..... A47F 5/0056

* cited by examiner

POSITION ADJUSTABLE SUPPORT ASSEMBLY

BACKGROUND OF THE INVENTION

Background

Support assemblies, especially wall mounted support assemblies typically provide extensions from the wall at fixed locations. Since the types of items to be supported range is sized and shape, the fixed extensions provide limited versatility for supporting various items.

SUMMARY OF THE INVENTION

The invention is directed to a position adjustable support assembly that comprises support extensions that extend from a support frame. The support frame has a pair of vertical support members coupled together by one of more horizontal support members. The support extensions are detachably attachable to the horizontal support members and are positionably adjustable along the length of the horizontal support member. The support extensions are attached to the horizontal support members by an extension attachment that comprises a gap opening that enables the extension attachment to be snapped over the horizontal support member. Any number of extension attachments and support extensions attached thereto may be attached to a horizontal support member.

An extension attachment may be t-shaped, having a support coupler with a length that extends along the length of the horizontal attachment and is configured for detachably attachment to the horizontal support member, and an extension coupler, for attachment of a support extension. The extension coupler may have a length that is orthogonal to the support coupler length, thereby producing a t-shaped extension attachment.

In an exemplary embodiment, the support coupler portion of an extension attachment has a circular inside surface that extends around a rod-shaped horizontal support member. The horizontal support member may further comprise a fin slot for retaining a fin that extends into support extension to prevent it from spinning about the horizontal support member. In an exemplary embodiment, a fin is slidably engaged within the fin slot of the horizontal support member, thereby enabling the fin and a support extension to be positioned along the length of the horizontal support member, as desired. A plurality of support extensions may be attached and detached to a horizontal support member as desired and then slid to a desired position.

A gap between the fins may be large enough to allow an extension attachment to be snapped onto and attached to the horizontal attachment between the fins or between a fin and a vertical support member or a horizontal attachment between a horizontal support member and the vertical support member. The extension attachment may then be slide over a fin, or a fin may be slid along the fin slot into the extension attachment. An extension attachment may have an inner retainer that enhances the attachment to the horizontal member. For example, a sleeve may be inserted into the inner portion of the support coupler to improve the attachment and retention of the extension attachment to the horizontal support member. The inner retainer may be made from a material that is has different properties than the rest of the extension couple, such as being more ductile or alternatively stiffer. For example, the inner retainer may be CPVC and the rest of the extension coupler may be PVC.

Poly vinyl chloride (PVC) is a thermoplastic polymer, while CPVC is a thermoplastic produced by the chlorination of the PVC resin. CPVC is significantly more ductile than PVC, thereby allowing greater flexure and crush resistance.

A support coupler of an extension attachment may further comprise a coupler retainer that extend from the extension coupler to the horizontal support member, thereby fixing the extension coupler and support extension in a fixed location along the length of the horizontal support member. The horizontal support member may have a plurality of retainer apertures for receiving the coupler retainer. Likewise, an extension coupler may have a retainer that extends through the extension coupler and into the support extension, thereby preventing the support extension from pulling out from the extension attachment or rotating. An exemplary extension coupler may be a circular shaped aperture for receiving a rod-shaped support extension, or a support extension having a circular cross-sectional outer surface.

An exemplary support frame may be positionably adjustable as well. The horizontal support members may be slid up and down along the length of the vertical support members and retained in position by horizontal attachment retainer that extend into retainer apertures within the vertical support members. A vertical support member may have a plurality of retainer apertures configured along the length of the vertical support member to enable vertical adjustment and fixation of the horizontal support members. A horizontal attachment may couple a horizontal support member to the vertical support member. An exemplary horizontal attachment has a circular aperture for sliding along a rod shaped vertical support member and may have a circular aperture for receiving and retaining the rod shaped horizontal support member. A horizontal attachment may be t-shaped like the extension attachment and may have a gap opening to allow the horizontal attachment to be snapped onto the vertical support member.

An exemplary support frame may be attached to a support surface, such as a wall by one or more brackets. These brackets may comprise a pivot to allow the support frame and position adjustable support assembly to rotate about the pivot, or out and way from the wall. A pair of upper brackets may be configured with a movable engagement feature to allow a pivoting support frame to be locked to upper bracket. The moveable engagement feature may be slid or rotated up to allow the vertical support member to rotate into position to the upper bracket and then the moved down to engage with the vertical support member and lock it into place.

An exemplary extension attachment or horizontal attachment may have a gap opening that extends an effective radius to allow it to be snapped over a rod-shaped member. The extension attachment or horizontal attachment may flex or expand to allow detachable attachment to the rod-shaped member. The ends of the extension that define the gap attachment or horizontal attachment may spread apart and expand and then quickly clamp shut around the rod-shaped member when the extension attachment or horizontal attachment is snapped into place. The gap radius may therefore be about 70 degrees to about 140 degrees, about 80 degrees to about 140 degrees, about 90 degrees to about 140 degrees, about 100 degrees to about 140 degrees, about 110 degrees to about 140 degrees and any range between and including the radius values provided, such as about 80 degrees to about 120 degrees, for example. When the radius of the gap is smaller, it may be more difficult to snap the attachment into location about a rod-shaped member and if the radius is too large, it may not provide adequate retention.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
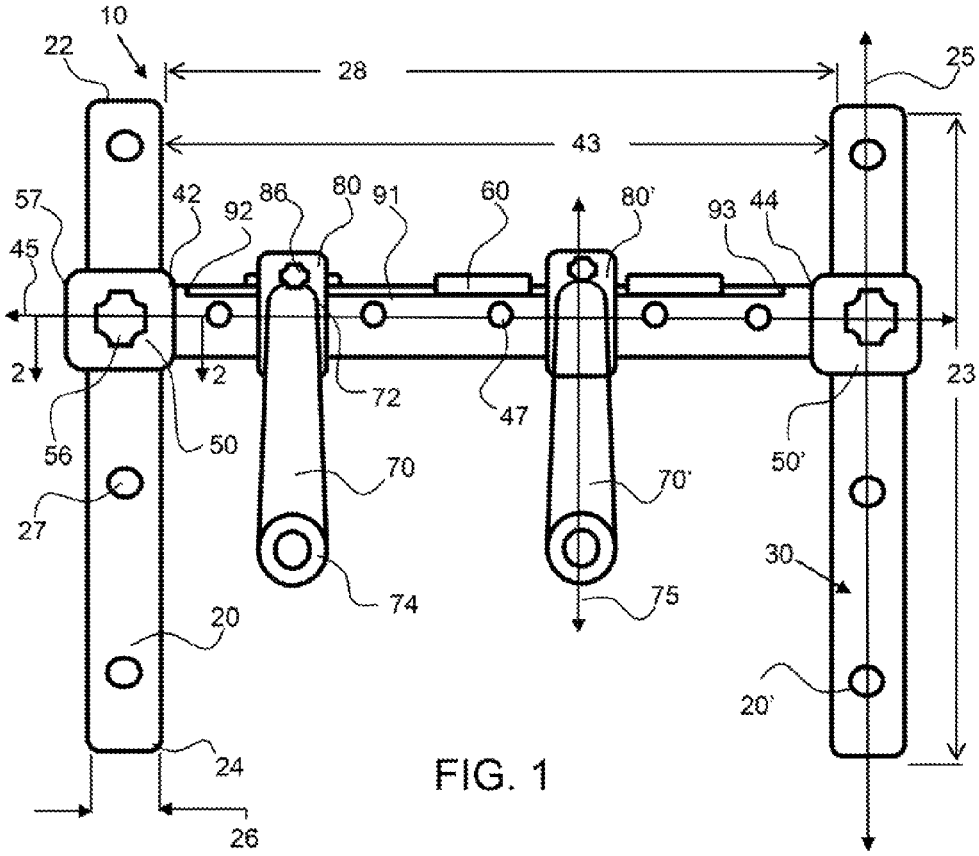
FIG. 1 shows a front view of an exemplary position adjustable support assembly comprising a pair of vertical support members having a horizontal support member extending therebetween. A pair of support extension are attached to the horizontal support member by an extension attachment.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
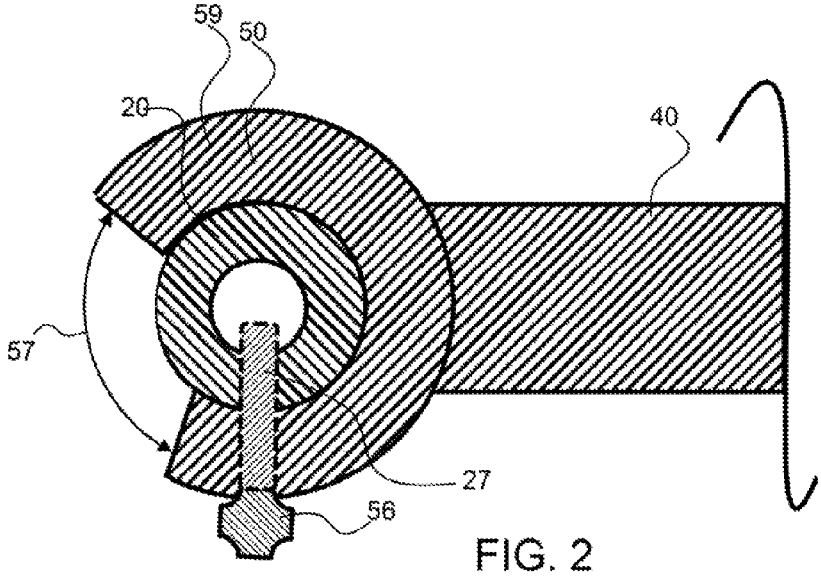
FIG. 2 show a cross-section view of a horizontal attachment coupled to a vertical support member.

Referring to FIGS. 1 and 2, an exemplary position adjustable support assembly 10 comprises a support frame 30 comprising a pair of vertical support members 20, 20' having a horizontal support member 40 extending therebetween. The two vertical support members are space apart by an offset distance 28. A pair of support extension 70, 70' are attached to the horizontal support member by an extension attachments 80, 80'. The vertical support members have a length axis 25 that extends along the length of the vertical support member from the first end 22 to the second end 24. The horizontal support members are attached to the vertical support member by horizontal attachment retainers 56 that extend into the vertical support retainer apertures 27. There are a plurality of vertical support retainer apertures along the length of the vertical support member 23 to allow a user to retain the horizontal support member in desired location along the length of the vertical support member. The vertical support members have a length axis 25 that extends along the length of the vertical support member from the first end 22 to the second end 24. The vertical support member has a width or diameter 26. The horizontal support member is retained by horizontal attachments 50, which may be a collar that fits completely around the vertical support members, or a horizontal coupler 59, as shown in FIG. 2 that extend partially around the vertical support member and are retained by the horizontal attachment retainer 56. As show in FIG. 2, the horizontal attachment 50 is extended around the vertical support 20. The horizontal attachment gap 57 allows the attachment to snap around the vertical support member and the horizontal support retainer 56 extends into the retainer aperture 27 of the vertical support to retain the horizontal support in a fixed location on the vertical support member. The horizontal support member 40 may rotate within the horizontal attachment 50 and a set pin or screw 54 may lock the horizontal support member in a rotation position with respect to the vertical support member 20, as shown in FIG. 2.

Figure 3:
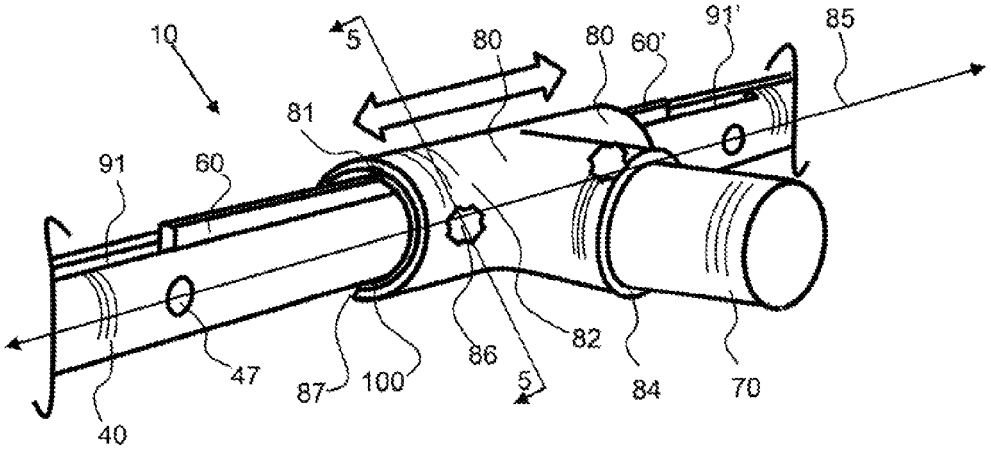
FIG. 3 shows a perspective view of a support extension attached to a horizontal support member by a coupler that snaps onto the horizontal support member and is retained by fin that extends in a fin slot of the horizontal support member and into the retainer slot of the coupler to retainer the coupler in a fixed rotational position to the horizontal support member.
Figure 4:
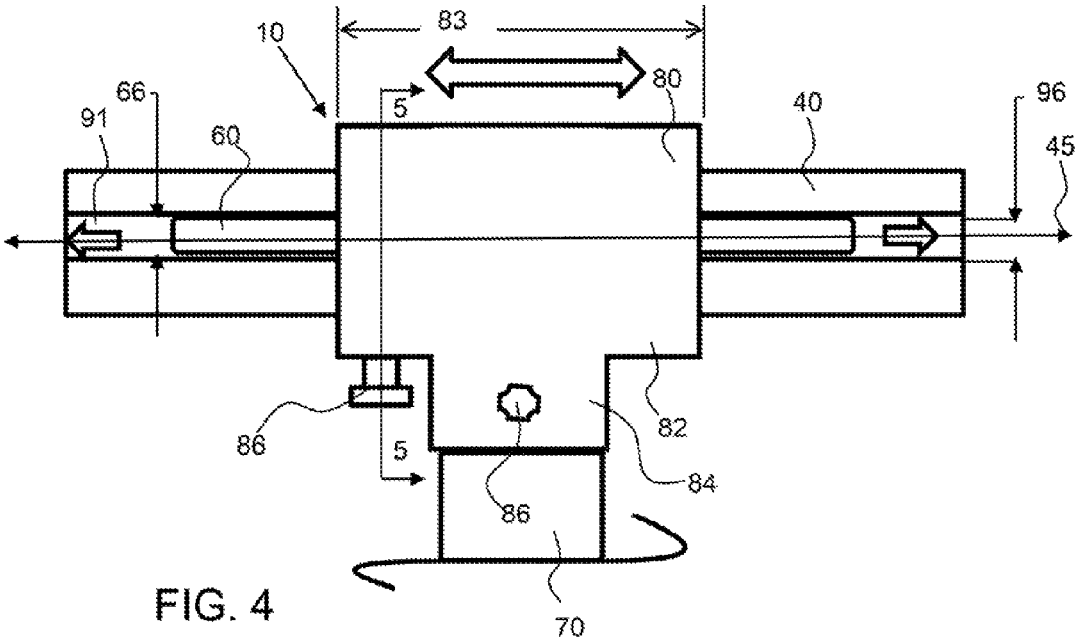
FIG. 4 shows a top-down view of an exemplary coupler attached to a horizontal support member.

Referring now to FIGS. 3 and 4, a support extension 70 is coupled to a horizontal support member 40 by extension attachments 80. The exemplary extension attachment 80 is t-shaped having a support coupler 82 portion having a length 83 and length axis 85 that is parallel with the length axis 45 of the horizontal support member 40, when attached thereto. The exemplary extension attachment 80 has an extension coupler 84 portion that extends perpendicularly to the extension coupler portion and has an aperture for receiving the support extension 70. The support extension is inserted into the extension coupler 84 portion of the extension attachment 80 and a retainer 86' may extend through the extension attachment and into the support extension 70.

Referring now to FIGS. 1, 3, 4 and 5, a support extension 70 is coupled to a horizontal support member 40 by extension attachments 80. As shown in FIG. 1, two extension attachments are coupled to the horizontal support member and have a length axis 75 that is perpendicular to the horizontal support member length axis 45. The horizontal support member has a length 43 from a first end 42 to a second end 44. The support extensions have a length from an attached end 72 to an extended end 74. As best shown in FIGS. 3 and 4, the extension attachment 80, or support coupler 82, has a gap 87 that allows the support coupler to snap over and onto the horizontal support member 40. A fin slot 91 extends along the horizontal support member and has a length from a first end 92 to a second end 93. The length may be substantially the length of the horizontal support member 40. A fin 60 is retained in the fin slot 91 and can slide within the slot along the length of the fin slot or the horizontal member. The support coupler 82 has a retaining slot 81 that allows a fin to be slid into the support coupler to retain the support coupler in a fixed rotational position with respect to the horizontal support member. The support extension 70 and support coupler 82 may be slid however along the length of the horizontal support member 40, as indicated by the double ended bold arrow. This allows positioning the support extension between the vertical supports as desired. A coupler retainer 86 may be used to fix the support coupler 82 and support extension 70 in a fixed position along the length of the horizontal support member. The horizontal support member has a plurality of retainer apertures 47 along the length of the horizontal support member 40. The fin and the support coupler may be slid together to a desired location. A plurality of fins 60 may be configured within a fin slot 91 and a gap distance between them may allow a coupler to snap onto and attach to the horizontal support member before the fin is located within the retainer slot 81 of the support coupler 82. As shown in FIG. 4, the fin slot 91 has a width 96 that is greater than the width 66 of the fin 60.

Figure 5:
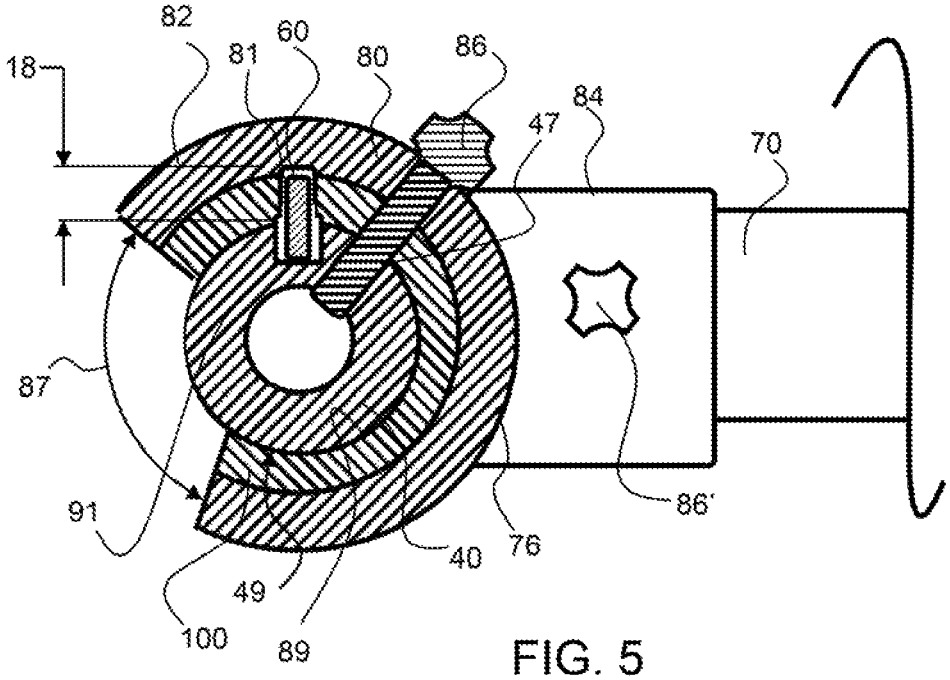
FIG. 5 shows a cross-sectional view of the coupler shown in FIG. 3, along line 5-5.

As shown in FIG. 5, an exemplary coupler 86 is inserted through the wall of the support coupler 82 and into the horizontal support member 40. The fin 60 is shown being configured within the fin slot 91 of the horizontal support member 40 and the retaining slot 81 of the coupler 82. The retaining slot height or depth 18 is shown and extends beyond the inner retainer 100. Also shown in FIG. 5 is the gap opening 87 that extends a radius about the support coupler 82. The inside surface 89 of the support coupler 82 is configured around the outside surface 49 of the horizontal support member. The inner retainer 100 is configured on the inside surface of the support coupler portion of the extension attachment 80. As described herein, the inner retainer may be a different material than the remaining portion of the extension attachment or the support coupler. The retaining slot may extend into or through the inner retainer. The support coupler 82 portion of the extension attachment is concentrically coupled about the horizontal support member 40.

Figure 6:
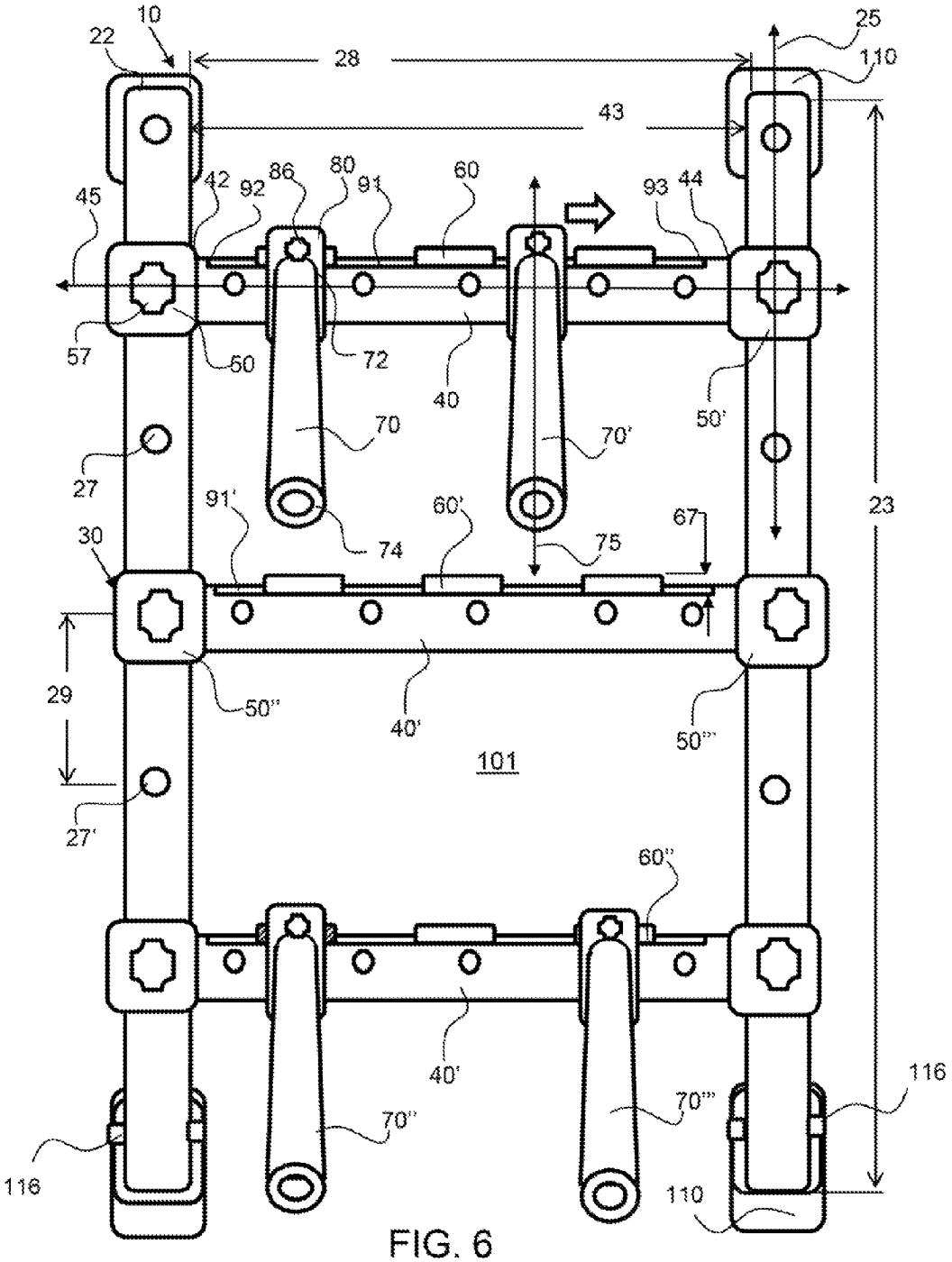
FIG. 6 shows a front view of an exemplary position adjustable support assembly having three horizontal support members that extend between two vertical support members.
Figure 7:
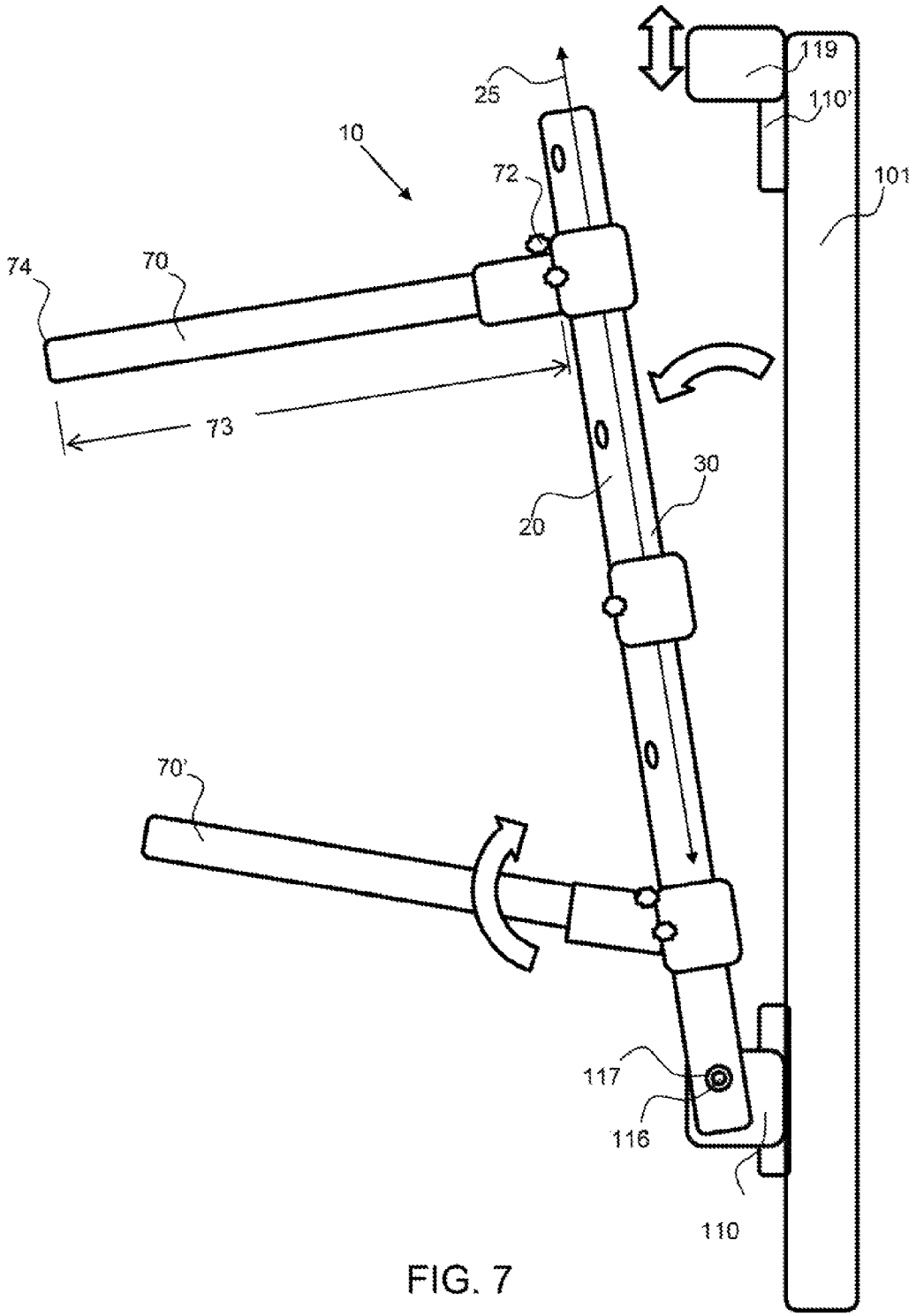
FIG. 7 shows a side view of an exemplary position adjustable support assembly with one of the horizontal support members rotates up and the vertical support members attached to a structure, such as a wall, by a bracket having a pivot.

Referring now to FIGS. 6 and 7, a support frame 30 is coupled to a support surface 101, such as a wall. As shown in FIG. 6, an exemplary position adjustable support assembly 10 has three horizontal support members 40, 40' and 40" that extend between two vertical support members 20, 20'. There are two support extensions 70, 70' attached to the top horizontal support member 40. One of the horizontal support members 70 is retained in a rotational position by a fin 60 and the other horizontal support member 70' has been snapped onto the horizontal support member but a fin has not been slid into the retainer slot of the extension attachment 80. The middle horizontal support extension 40' has a plurality of fins 60 in the fin slot 91' that are offset from each other to produce a fin gap that enables a horizontal support extension to be attached within said fin gap. The fins 60 extend up from the outside surface of the horizontal support members a fin height 67. The bottom horizontal support member 40" has two support extension 70" and 70''' attached thereto. The position adjustable support assembly 10 is coupled to a support, such as a wall, by a bracket 110 and the bracket has a pivot 116 to allow the assembly to rotate away from the wall, as shown in FIG. 7. Also shown in FIG. 7, the bottom support extension 70' is rotated up. The bottom horizontal support member 40" as shown in FIG. 6 may be rotated with respect to the vertical support members and retained in place by a set screw, for example. The support frame 30 is rotated about the pivot 116 in the bottom bracket 110. The upper bracket 110' has a movable engagement feature 119 to allow the support frame 30 to be pivoted back to the wall and then retained by the movable engagement feature. The movable engagement feature may slide or rotate up to allow the support frame to be pivoted into position and then slid down to engage and retain the support frame. In addition, the position adjustable support assembly 10 may be removed from the support surface or bracket by removal of the pin 117 in the lower brackets 110.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A position adjustable support assembly comprising:

a) a horizontal support member comprising:
- i) a circular cross-sectional shape;
- ii) a length from a first end to a second end;
- iii) a length axis that extends along the length of the horizontal support member;
- iv) an outside surface;
- v) a fin slot that extends along the length axis of the support member;

b) a fin extending perpendicularly a fin height from the outside surface of the support member and extending a portion of said length of the support member;

c) a support extension coupled to and extending substantially perpendicular to the support member and comprising:
- i) an attached end that is coupled to the support member;
- ii) an extended end that is extended out from the support member;
- iii) a length from said attached end to said extended end;

d) an extension attachment attaching the attached end of the support extension to the support member and comprising:
- i) a semi-circular cylindrical shaped support coupler comprising:
  - a length extending a length axis that is parallel with the support member length axis;
  - a gap opening extending along the length axis of the semi-circular cylindrical shaped support coupler to allow the semi-circular shaped-cylindrical shaped support coupler to extend around the horizontal support member in a concentric coupling arrangement;
  - an inside surface;

a retaining slot extending along the inside surface along the length axis of the semi-circular cylindrical shaped support coupler a slot depth;

wherein the slot depth is at least as large as the fin height ii) an extension coupler that is attached to the attached end of the support extension;

wherein the retaining slot is configured over the fin to secure the support extension to the support member and prevent rotation about the support member; and the support extension is detachably attachable to the support member and position adjustable along the length of the support member.

2. The position adjustable support assembly of claim 1, wherein the gap opening has a radius that is less than a diameter of the horizontal support member, thereby requiring flexing of the support coupler to engage around the horizontal support member.

3. The position adjustable support assembly of claim 1, wherein the gap opening extends a radius of no more than about 120 degrees.

4. The position adjustable support assembly of claim 1, comprising a plurality fins within the fin slot and a gap between two adjacent fins that is larger than the length of the support coupler and wherein a support coupler is detachably attachable to the support member with said gap between adjacent fins.

5. The position adjustable support assembly of claim 1, wherein the support member comprises a plurality of retainer apertures for receiving a coupler retainer that extends from the support coupler into one of said plurality of retainer apertures to retain the support coupler to the support member in a fixed location along the length of the support member.

6. A position adjustable support assembly comprising:

a) a plurality of vertical support members spaced apart by an offset distance;

b) a horizontal support member that is coupled to and extends between the plurality of vertical support members comprising:

i) a circular cross-sectional shape;

ii) a length from a first end to a second end;

iii) a length axis that extends along the length of the horizontal support member;

iv) an outside surface;

v) a fin slot that extends along the length axis of the horizontal support member;

c) a fin extending perpendicularly a fin height from the outside surface of the horizontal support member and extending a portion of said length of the horizontal support member;

d) a support extension coupled to and extending substantially perpendicular to the support member and comprising:

i) an attached end that is coupled to the horizontal support member;

ii) an extended end that is extended out from the horizontal support member;

iii) a length from said attached end to said extended end;

e) an extension attachment attaching the attached end of the support extension to the support member and comprising:

i) a semi-circular cylindrical shaped support coupler comprising:

a length extending a length axis that is parallel with the support member length axis;

a gap opening extending along the length axis of the semi-circular cylindrical shaped support coupler to allow the semi-circular shaped cylindrical shaped support coupler to extend around the horizontal support member in a concentric coupling arrangement;

an inside surface;

a retaining slot extending along the inside surface along the length axis of the semi-circular cylindrical shaped support coupler a slot depth;

wherein the slot depth is at least as large as the fin height ii) an extension coupler that is attached to the attached end of the support extension;

wherein the retaining slot is configured over the fin to secure the extension attachment to the horizontal support member and prevent rotation of the extension attachment and support extension about the horizontal support member; and wherein the support extension is detachably attachable to the horizontal support member and position adjustable along the length of the horizontal support member.

7. The position adjustable support assembly of claim 6, wherein the gap opening has a radius that is less than a diameter of the horizontal support member, thereby requiring flexing of the coupler to engage around the horizontal support member.

8. The position adjustable support assembly of claim 6, wherein the gap opening extends a radius of no more than about 140 degrees.

9. The position adjustable support assembly of claim 6, wherein the horizontal support member comprises two fins extending a portion of the length of the horizontal support member producing a fin gap between the two fins that is at least as large as the length of the extension attachment.

10. The position adjustable support assembly of claim 9, wherein the fin is slidably engaged with the horizontal support member to slide along the length of the horizontal support member.

11. The position adjustable support assembly of claim 6, wherein the horizontal support member comprises a plurality of retainer apertures for securing said extension attachment in fixed position along the length of the horizontal support member by a coupler retainer that extends from the extension attachment into the retainer apertures.

12. The position adjustable support assembly of claim 6, wherein the vertical support member comprises a plurality of retainer apertures for securing the horizontal attachment in fixed position along the length of the vertical support member by a coupler retainer that extends from the horizontal attachment into the retainer apertures.

13. The position adjustable support assembly of claim 6, wherein the support extension is rotatably coupled with the extension attachment and wherein the attached end of the support extension comprises a plurality of retainer apertures configured about the circumference that are engaged by a coupler retainer that extends from the extension attachment into said retainer apertures.

14. The position adjustable support assembly of claim 6, wherein the horizontal support member is coupled to at least one of the vertical support members by a horizontal attachment comprising a semi-circular cylindrical shaped coupler comprising:

i) length extending a length axis that is parallel with the vertical support member length axis;

ii) a gap opening extending along the length axis of the semi-circular cylindrical shaped coupler having a gap opening that is large enough to allow the semi-circular cylindrical shaped coupler to extend around the vertical support member in a concentric coupling arrangement.

15. The position adjustable support assembly of claim 14, wherein the horizontal attachment comprises horizontal attachment retainer and wherein the vertical support members comprise a plurality of apertures along the length of the vertical support member for receiving a horizontal attachment retainer that extends into said apertures to secure the horizontal support member to the vertical support member.

16. The position adjustable support assembly of claim 6, comprising a mounting bracket having a pivot, wherein the position adjustable support assembly is rotatable about said pivot and from a mounting support.

17. The position adjustable support assembly of claim 16, wherein the mounting bracket is configured on a bottom end of the vertical support members and wherein an upper mounting bracket is movable engagement feature to enable a top of the vertical support members to be retained and released from the upper mounting bracket.

18. The position adjustable support assembly of claim 6, wherein the support coupler comprises an inner retainer that extends along a length of the support coupler and within the inside surface of the support coupler and wherein the support coupler is a different material than the inner retainer.

* * * * *